US006889394B2

(12) United States Patent
Guillen

(10) Patent No.: US 6,889,394 B2
(45) Date of Patent: May 10, 2005

(54) FAUCET HANDLE SAFETY DEVICE

(76) Inventor: Paula Guillen, 2823 Cottonwood Ave., Bellingham, WA (US) 98225

( * ) Notice: Subject to any disclaimer, the term of this patent is extended or adjusted under 35 U.S.C. 154(b) by 281 days.

(21) Appl. No.: 10/267,625

(22) Filed: Oct. 8, 2002

(65) Prior Publication Data

US 2003/0066128 A1 Apr. 10, 2003

Related U.S. Application Data

(60) Provisional application No. 60/328,232, filed on Oct. 9, 2001.

(51) Int. Cl.[7] ..... A47K 3/00
(52) U.S. Cl. ..... 4/559; 137/382
(58) Field of Search ..... 4/546, 559, 580, 4/657; 137/377, 381, 382

(56) References Cited

U.S. PATENT DOCUMENTS

| | | | | | |
|---|---|---|---|---|---|
| 89,930 | A | | 5/1869 | Hall | 137/382 X |
| 991,216 | A | | 5/1911 | Lawrence | 137/382 X |
| 1,084,996 | A | | 1/1914 | Wright | 137/382 X |
| 1,690,461 | A | * | 11/1928 | Sieben | 137/382 |
| 3,199,121 | A | * | 8/1965 | Greto | 4/559 X |
| 3,940,196 | A | | 2/1976 | Ketchel | 312/237 |
| 4,162,740 | A | * | 7/1979 | Jones | 137/382 X |
| 4,301,828 | A | | 11/1981 | Martin, Jr. | 137/381 |
| 5,217,201 | A | | 6/1993 | Self | 251/90 |
| 5,263,853 | A | | 11/1993 | Pall | 137/382 |
| 5,590,682 | A | | 1/1997 | Fischer | 137/382 |
| 5,956,808 | A | | 9/1999 | Tom | 16/121 |
| 5,964,246 | A | * | 10/1999 | Meeker | 137/382 X |
| 6,145,534 | A | | 11/2000 | Romero | 137/382 |

* cited by examiner

*Primary Examiner*—Robert M. Fetsuga
(74) *Attorney, Agent, or Firm*—William L. Haynes; Garrison & Assoc. PS

(57) ABSTRACT

A device for covering a water faucet handle, and thereby denying access to the handle by small children and others lacking the mental discernment to appreciate and consider the consequences of their actions. The device comprises a generally L-shaped mounting member that is placed over the faucet handle and attached to a structural wall, and a generally rectangular, box-shaped cover that is hingedly connected to the mounting member. The device is held in its closed and locked position by a pair of spring fingers, defined by two parallel notches in the lateral sidewalls of the cover, wherein the catch member, which is located on the terminal end of each spring finger, is engaged with a catch slot in the spring finger catch that is located on the mounting member. The device is opened by simultaneously applying a lateral force to both spring fingers and rotating the cover downward.

15 Claims, 4 Drawing Sheets

FIG. 1
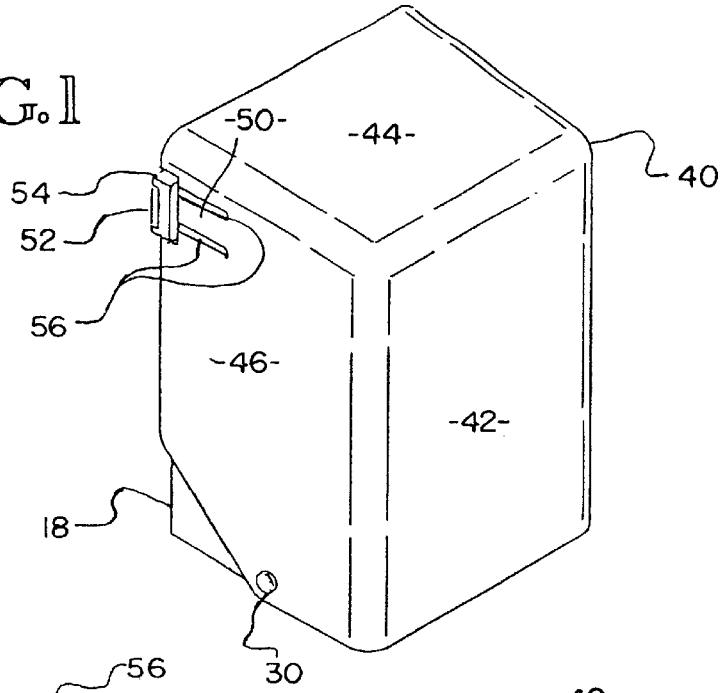
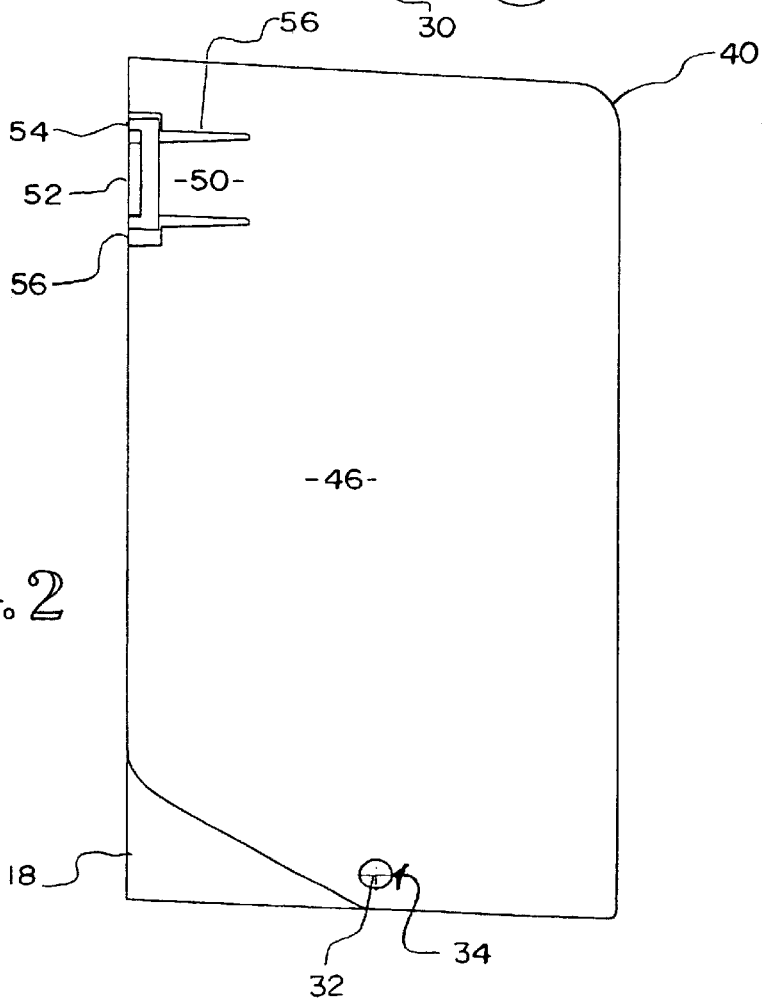
FIG. 2

FIG. 3
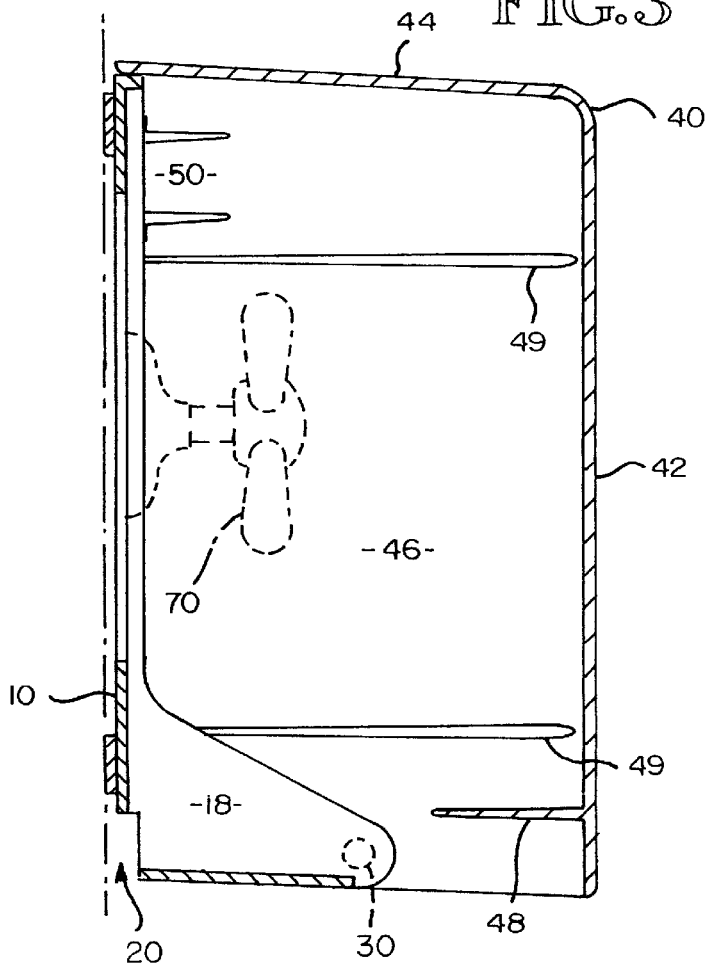
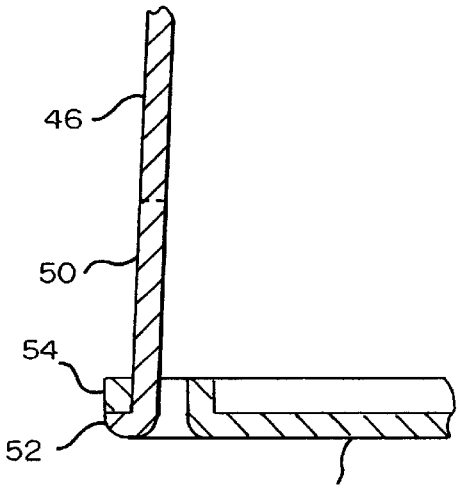
FIG. 4
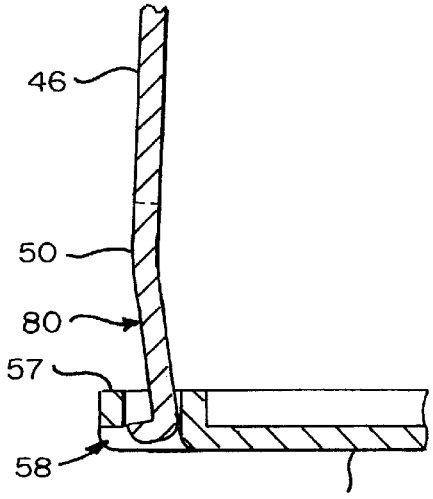
FIG. 5

FAUCET HANDLE SAFETY DEVICE

CROSS-REFERENCE TO RELATED APPLICATIONS

This application claims priority from and the benefit of U.S. Provisional Application Serial No. 60/328,232, entitled "Safety Tap," filed Oct. 9, 2001.

TECHNICAL FIELD

The invention relates to protective covers for knobs and levers used to open water valves in residential and light commercial plumbing systems. In particular, this invention describes a cover for use in a bath tub or shower to prevent small children, and others lacking the mental discernment to appreciate and consider the consequences of their actions, from opening the water valves.

BACKGROUND OF THE INVENTION

It can sometimes occur that small children who are either in or near a bathtub may be inclined to touch and manipulate the faucet handles if left temporarily unattended. If the hot water valve is opened, the danger at of scalding is at once realized. While many municipal codes attempt to regulate the temperature settings of water heaters, and thereby prevent the water from reaching a temperature where scalding will occur, there exists a danger that the setting on a water heater could be inadvertently changed. Even if the water temperature is not sufficient to scald an unattended child, an extended period of unrestricted flow of hot water into a bathtub could elevate the overall water temperature sufficiently so as to overheat the core body temperature of a child, thus producing, in the worst case scenario, a potentially life-threatening situation. There is also the danger that the child might recoil in shock arising from contact with the hot water and possibly sustain a physical injury.

Similarly, if the cold water knob is opened there is danger that a child might recoil in shock arising from contact with the cold water and possibly become injured. If the flow of cold water is allowed to continue, there arises the danger of decreasing the overall water temperature a sufficient amount so as to decrease the core temperature of the child thus once again producing, in the worst case scenario, a potentially life threatening situation.

There are also other forms of damage that can arise from a prolonged flow of running water. Perhaps the least damaging of these involves the cost associated with the excessive use of water. There is also the danger that an overflow condition can occur possibly spilling water out of the tub and onto the floor and surrounding structures. It is well known that water damage, caused by leakage, spillage, or flooding, can be a substantial cause for loss, as any insurance company can affirm.

Numerous devices have been proposed or revealed which prevent children and others from accidentally or intentionally opening water valves. Typically these devices either prevent access to the valve manipulation device, or they lock the valve manipulation device in some manner so as to prevent rotation. Examples of apparatus that are used to prevent access to the valve manipulation device can be found in U.S. Pat. No. 6,145,534, issued to Romero, U.S. Pat. No. 5,956,808, issued to Tom, U.S. Pat. No. 5,263,853, issued to Pall, and U.S. Pat. No. 3,940,196, issued to Ketchel.

The patent issued to Romero discloses a guard over an existing faucet valve, which prevents a child from changing the water input settings when the guard is in place. The device has two generally hemispherically shaped sections, each of which has an aligned lower cutoff base opening. These cutoff openings are joined together to form a single lower base opening which encloses the stem of the water valve at its base. A spring hinge joins the sections together at facing side edges, and when closed, the guard freely rotates about the enclosed valve. The hinges on the spring are said to be of sufficient strength to prevent a child from opening the guard while still allowing an adult to open the guard by prying the hemispherically shaped sections apart. While this guard is adequate to prevent a casually interested child from having access to the water valve, no provision is provided to prevent a determined or inquisitive child from using some tool as a lever to pry the hemispherically shaped sections of the guard apart.

The patent issued to Tom discloses a removable rotary knob cover having an inner casing and an outer casing. The cover can rotate freely about the knob when installed, and must be completely removed to access the knob. The cover is removed by opening a hinged door held in place by a latching mechanism. Releasing the latching mechanism to open the door is a complicated two step process requiring that the mechanism be manipulated by three digits. Such manipulation could potentially be difficult for a care giver with small hands or fingers.

The patent issued to Pall discloses a wall-mountable hinged protective cover for a faucet handle having a locking mechanism. Access to a faucet handle is gained by hingedly opening a bowl-shaped cover. In one embodiment of the device, the locking mechanism is a latch engaged in a catch. The latch is held in the catch by frictional force said to be greater than a small child can overcome, but not so great that an adult would be unable to dislodge the latch from the catch. This mechanism would suffice in most situations, but it would not prevent a determined child or a child using a tool or lever from dislodging the latch and gaining access to the water faucet.

In another embodiment of the device taught by Pall, a small finger opening is present in the bowl-shaped cover. The cover is held in place by a latch and access to the latch is gained by inserting a finger through the small opening. Pall teaches that a small child will not be able to figure out the design or have a finger long enough to reach the latch through the opening. This particular embodiment of the device taught by Pall could be potentially difficult to open for adults with short or stubby fingers.

The patent issued to Ketchel discloses a cover for a hot water valve in a bathtub that comprises contoured sidewalls and a hinged front cover locked in place by a latching mechanism. The latching mechanism comprises two protruding levers that contain spring-biased pincers that must be squeezed toward one another by the user to release the cover. Operation of the latching mechanism requires a force of sufficient magnitude to prevent small children from opening the cover, lifting the cover, and operating the faucets. However, the levers of the latching mechanism are so close together on the front of the cover that it is entirely possible for a strong child to manipulate the mechanism.

U.S. Pat. No. 5,590,682, issued to Fisher, is an example of a locking device that prevents rotation of a water faucet handle. The apparatus of Fisher is a hinged device capable of covering two water faucet valve handles, and includes provisions for using a padlock to lock the device in place. This ungainly device must be completely removed before one can use the water, and therefore, would not prevent access to the faucet handles by a child who was temporarily left unattended while bathing, unless it was repositioned and the padlock was placed back on the device.

Accordingly, there exists a need for an apparatus that is easy to install, which will prevent access to water faucet handles by children and adults unable to discern the consequences of their actions. Such a device should have a locking mechanism capable of denying access to such persons, yet easily manipulated by adults (including those adults, who cannot manipulate the devices described above). Such a device that could be easily installed, is easy to use, and quickly placed in its closed position when the need arises to temporarily leave a bathing person unattended would be a useful and desirable device.

SUMMARY OF THE INVENTION

Before the current invention is described, it should be noted that the terms "faucet handle" or "water faucet handle," as used herein, indicate the various forms of devices used to open and close the water valves in a residential or light commercial plumbing system.

Accordingly, it is an object of this invention to provide a device to cover the water faucet handle in a bathtub.

It is also an objective of this invention to provide such a device that is easy to install over an existing faucet handle.

It is another object of this invention to provide such a device that can be semi-permanently installed should there be a need for such installation.

Yet another object of this invention is to provide such a device having a hinged front cover.

A further object of this invention is to provide such a device with a latching mechanism that can be easily manipulated by an adult with normal cognitive skills, yet unable to be manipulated by children or those with impaired cognitive abilities.

It is also an object of this invention to provide such a device that can be used for faucet handles of different sizes.

Still another object of this invention is to provide such a device that is easily installed.

A yet further object of this invention to provide such a device that is relatively inexpensive to produce.

The current invention discloses a device that meets the objects above and others as will become readily apparent by the disclosure herein. The device of the current invention is comprised of a stationary mounting member which is attachable to a structural wall immediately above a bathtub (or some other surface at the location of a water faucet handle), and a movable cover for the handle. The cover is hingedly mounted at a hinge location in the lower part of the mounting member. In the closed position the faucet handle is entirely enclosed.

To keep the cover in place in the closed position, there are two manually operable fastening devices on opposite sides of the cover and adjacent to the back wall. These two fastening devices each comprise a spring finger and a catch member that fits in a slot in the mounting member. The cover is opened by depressing the two spring fingers inward simultaneously and rotating the cover downwardly to the open position.

Various preferred embodiments of the device can be used to cover differently shaped and differently sized water faucet handles in bathtubs, showers, or the dials of hot tubs. When the device of the current invention is installed over the water faucet handle or the shower faucet handle and the cover is in the closed position, water flow cannot be manipulated. When a care giver wants to give a child or mentally impaired person a bath or shower, the care giver would simply depress the two spring fingers on each side of the moveable cover and simultaneously pull downwardly on the moveable cover until the cover is in its open position. The faucet handle would be exposed and the care giver could adjust the water temperature and water flow until the bathtub is filled with the desired amount of water or the desired shower temperature is reached. Once the adjustments have been made, the care giver would close the moveable cover and engage the spring finger latching mechanism.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

FIG. 1 is a perspective view of the faucet cover of the current invention.

FIG. 2 is a side view of the faucet cover of the current invention.

FIG. 3 is a cross-sectional side view of the current invention showing the faucet cover mounted on a wall, and closed over a faucet handle.

FIG. 4 is a cross-sectional top view showing the spring finger latch of the current invention in its closed position.

FIG. 5 is a cross-sectional top view showing the operation of the spring finger latch as inward force is applied to the spring finger.

BEST MODE OF CARRYING OUT THE INVENTION

Figure 6:
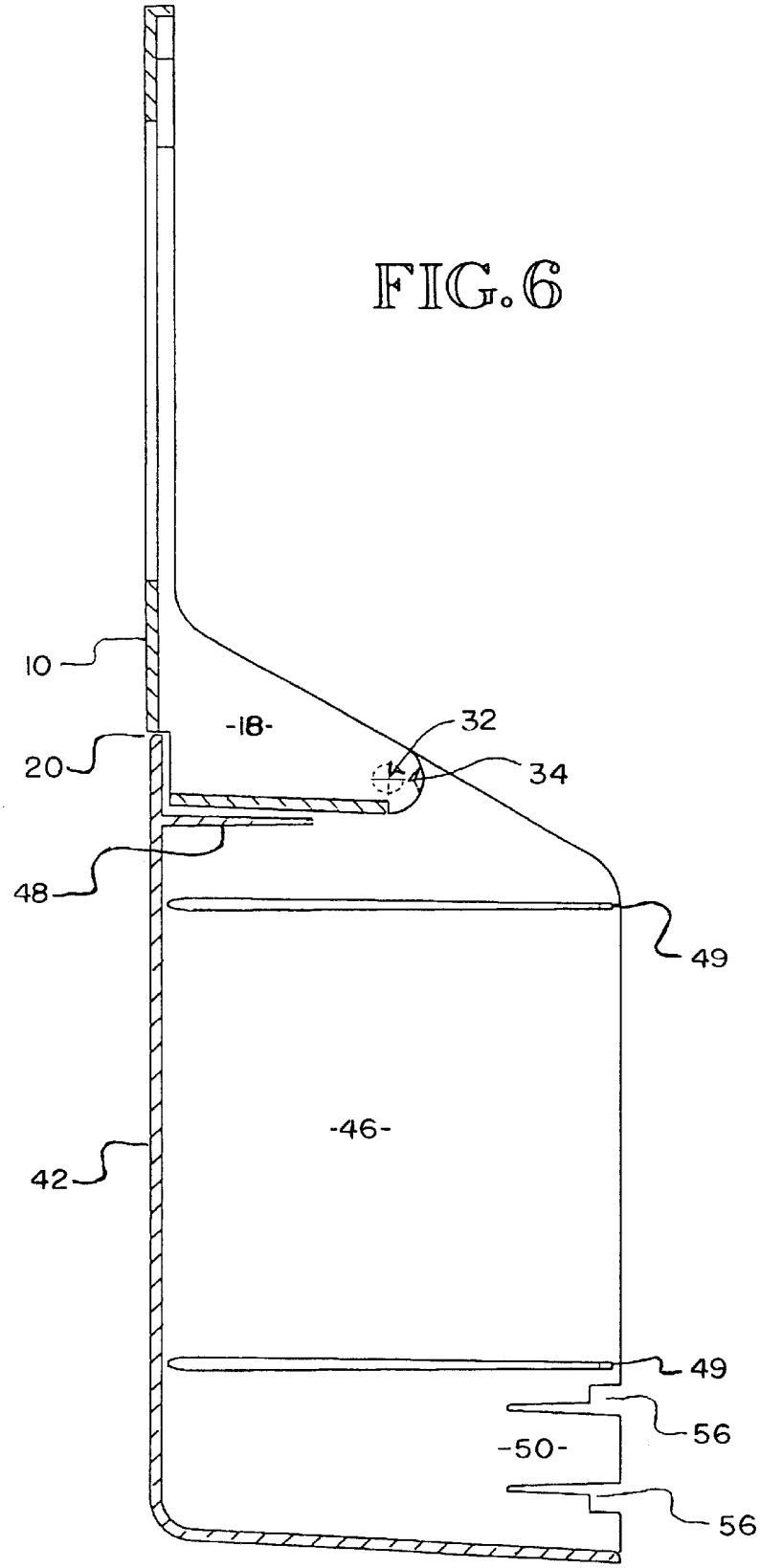
FIG. 6 is a cross-sectional side view of the current invention showing the cover in its open position.

Referring now to the drawings, the invention will be described in preferred embodiments by reference to the numerals of the drawing figures wherein like numbers indicate like parts, and particularly to FIG. 1 and FIG. 2, the device of the current invention is shown. The safety device of the current invention has a generally rectangular, box-shaped cover 40 having a cover plate 42. A pair of lateral sidewalls 46 and a top wall 44 extend inwardly from the cover plate 42.

The generally L-shaped mounting member 10 can be seen in FIG. 6. The mounting member 10 has gently sloping sidewalls 18 on the lower portion thereof. Referring again to FIG. 1 and FIG. 2, the cover 40 is hingedly connected 30 to each side of mounting member by inserting the cylindrical nub 32, located on the mounting member sidewalls 18, through a round hole 34 communicating through the lateral sidewalls 46.

Located near the top edge of the mounting member, is spring finger catch 54. The cover 40 is secured to the mounting member by inserting the spring fingers 50 into the spring finger catch 54, such that the catch member engages with the catch slot. The spring fingers are defined by two parallel notches 56 extending toward the cover plate 42 from the edge of the sidewalls 46 opposite the cover plate. The cover 40 is opened by simultaneously applying a lateral force, sufficient to disengage the catch member from the catch slot, to both spring fingers and rotating the cover downward about the hinges 30.

The safety device of the current invention is constructed from a composite plastic material having sufficient elastic memory such that when the lateral force is removed, the spring fingers will bias to their original position. The material also has sufficient resistance to deformation, such that it is a small child cannot apply sufficient force to disengage the catch member from the catch slot. Additionally, the cover is sufficiently wide that a small child will not be able to place two digits from one hand on both spring fingers to depress them simultaneously. Any child attempting to gain access to a faucet handle would have to press on the spring fingers with both hands simultaneously, this would require a level of coordination beyond the ability of children who should not have access to the faucet handle.

Figure 7:
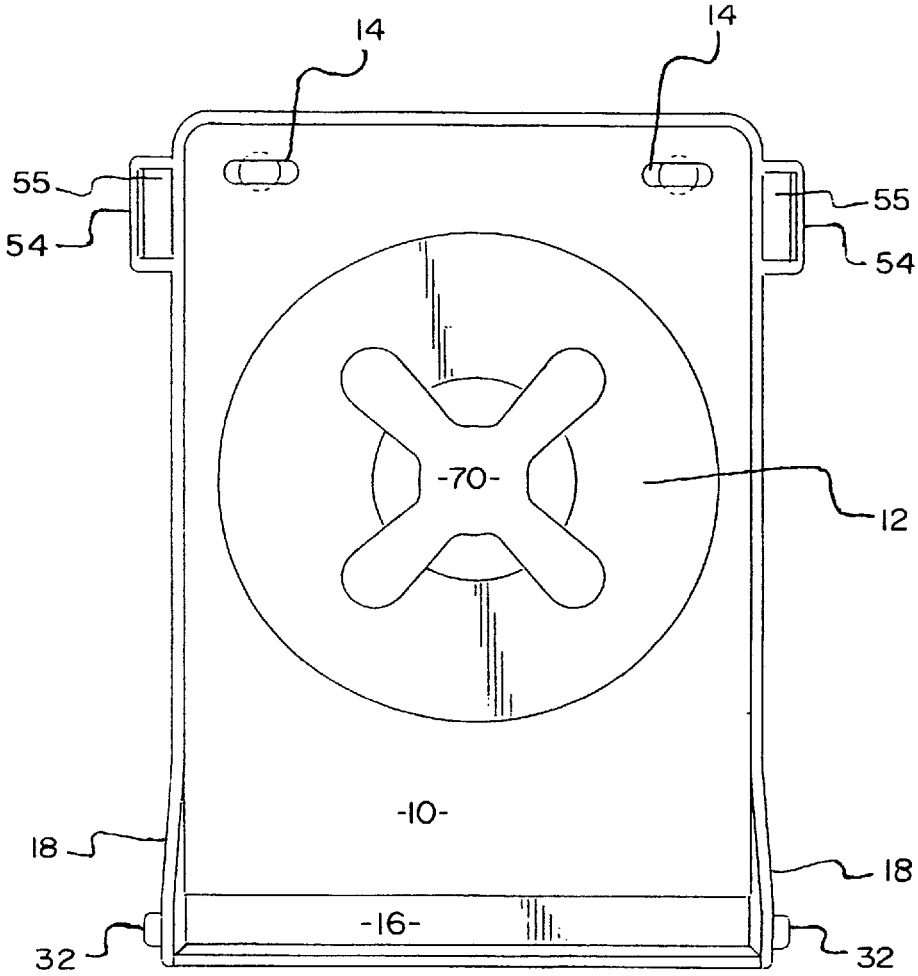
FIG. 7 is a front view of the stationary mounting member of the current invention placed over a water faucet handle.

Referring to FIG. 7, which illustrates the mounting member 10 of the current invention placed over a faucet handle 70. The mounting member 10 is generally L-shaped having a bottom plate 16 and gently sloping sidewalls 18 (FIG. 6). Each sidewall has a generally cylindrical nub 32 protruding outward from the sidewall for engagement with the round holes communicating through the lateral sidewalls of the cover.

A faucet handle insertion hole 12 is provided for insertion over a faucet handle. A layer of adhesive material is located on the back surface of the mounting member. The mounting member is attached to the structural wall by removing the cover from the adhesive material, placing the faucet handle insertion hole over the faucet handle and pressing the adhesive surface against the wall. If semipermanent installation is desired, a plurality of mounting holes 14 are provided for securing the mounting member to the structural wall above the faucet handle with screws or similar fastening devices. A spring finger catch 54 is located on each side of the mounting member for insertion of the spring fingers, located on the cover, into the rectangular opening 55 in the spring finger catch 54.

Referring now to FIG. 3, which is a cross sectional view of the device of the current invention installed over a faucet handle 70. The mounting member 10 is attached to the structural wall above the faucet handle. The structural wall and a small offset in the back of the mounting member creates a slot 20 for accepting the lower portion of the cover plate 42 when the cover is rotated to its open position. The cover 40 is held in place over the mounting member 10 by insertion of the spring fingers 50 into the spring finger catches such that the catch member of each spring finger is engaged by the catch slot in its respective spring finger catch.

Access to the faucet handle is denied from the front, and the sides by the cover plate 42, and the lateral side walls 46. Access from below is denied by the bottom plate 16 and a flange 48 protruding from the interior surface of the cover plate. When the cover is locked in the closed position, there is a very small opening between the flange 48 and the bottom plate 16 to allow for drainage and ventilation.

FIG. 4 and FIG. 5 are cross sectional views taken from above, which illustrate the operation of the spring fingers. In these figures, the dashed line through the sidewall 46 shows the termination point of the notches that define the spring finger 50. At the terminal end of each spring finger 50, is a catch member that extends outward from the end of the spring finger. A small slot, communicating through the wall of the spring finger catch 54, forms the catch slot 58.

When the cover is rotated toward its closed position, the ends of the spring finger 50 are rotated into the spring finger catch 54. The beveled interior edge 57 of the spring finger catch redirects any closing force that is longitudinal to the spring finger by forcing the catch member 52 inward. When the catch member 52 reaches a point where it is even with the catch slot 58, the spring finger biases to its original position and the cover is securely engaged over the faucet handle.

Referring specifically to FIG. 5, when a lateral force 80 is applied to the spring finger 50 the catch member 52 is disengaged from the catch slot 58. The cover can then be rotated downward to its open position.

FIG. 6 is a cross section take from the side, which illustrates the safety device of the current invention in its open configuration. There can be seen in this figure the generally L-shaped mounting member 10 having a pair of sloping side walls 18. The mounting member 10 has a small offset on the lower portion of the mounting member, which creates a small slot 20 when the mounting member is attached to a flat surface.

When the cover 40 is rotated about the hinges, formed by the nubs 32 on the mounting member and the holes 34 communicating through the lateral sidewalls 46 of the cover, the lower portion of the cover plate 42 rests in the slot. Ribs 49 provide extra rigidity to the cover. The spring fingers 50 are each defined by a pair of notches 56 extending toward the cover plate from the edge of the lateral sidewalls that is opposite the cover plate.

In its open position, the cover rests against the structural wall below the faucet handle and the mounting member. This position keeps the cover out of the care giver's way while the faucet handle is being manipulated. Additionally, because the handle rotates downward instead of upward, there is no danger that the cover will inadvertently fall and strike the care giver's hand while the faucet handle is being manipulated.

The safety device of the current invention can be used to cover the water faucet handle in a bathtub thereby denying access to the faucet handle by small children and other who cannot discern the consequences of their actions. The device is easily installed, and various preferred embodiments of the invention can be dimensioned to cover various sizes and shapes of faucet handles. This safety device can be semipermanently installed, and it has a hinged front cover that is held in place by a manually operable latching mechanism.

The cover of the device is constructed from a material having sufficient elastic memory such that when a lateral force is removed from the spring fingers, they will bias to their original position. This causes the catch members, to be engaged by the catch slots and holds the cover in its closed position. The material also resists deformation such that a small child will not be able to generate the force necessary to disengage the catch member from the catch slot. Additionally, the cover is sufficiently wide that a small child will not be able to manipulate both spring fingers with a single hand.

To install the device of the current invention, the cover is removed from the layer of adhesive material on the back surface of the mounting member and the faucet handle is inserted through the faucet handle insertion hole 12, which communicates through the mounting member 10. The mounting member is oriented so that the mounting holes 10 are above the faucet handle, and the adhesive material is pressed firmly against the structural wall. If a semipermanent installation is desired, fastening devices are then inserted through the mounting holes to secure the mounting member to the structural wall. The cover is then rotated upward until the catch member is engaged in the catch slot such that the cover is locked in its closed position.

If a care giver wishes to bathe a child, he or she simply manipulates both spring fingers simultaneously by applying a lateral force inwardly until the catch members are disengaged from the catch slot. The cover is then rotated downward and the water can be turned on. Once the desired water level has been reached, the water is turned off and the cover can be closed. If the care giver must leave momentarily, the safety device of the current invention will prevent the child from accessing the faucet handle. The safety device of the current invention can also be used on cold water faucet handles to prevent unauthorized access to the handle.

Industrial Applicability

The invention has applicability to the field of protective covers for faucet handles used to open water valves in residential and light commercial plumbing systems. In compliance with the statute, the invention has been described in language more or less specific as to structural features. It is to be understood, however, that the invention is not limited to the specific features shown or described, since the means and construction shown or described comprise preferred forms of putting the invention into effect. Additionally, while this invention is described in terms of being used to prevent small children, and others lacking the mental discernment to appreciate and consider the consequences of their actions, from opening the hot water valve in a shower or bathtub, it will be readily apparent to those skilled in the art that the invention can be adapted to other uses in preventing access to valve manipulation devices as well, and therefore the invention should not be construed as being limited to denying access to hot water faucet handles. The invention is, therefore, claimed in any of its forms or modifications within the legitimate and valid scope of the appended claims, appropriately interpreted in accordance with the doctrine of equivalents.

What is claimed is:

1. A device for denying access to a water faucet handle comprising;

a generally L-shaped mounting member having an upper portion and a lower portion and two side edges;

said mounting member further having a pair of side walls extending outwardly from said lower portion;

said mounting member having a faucet handle insertion hole communicating therethrough for insertion of a faucet handle;

said mounting member adaptable for mounting on a structural wall;

said mounting member having a spring finger catch on each of said side edges;

a generally rectangular, cover having, a cover plate a top plate, two lateral sidewalls, and a flange;

said top plate, said lateral sidewalls, and said flange extending inwardly from said cover plate thereby forming a box-shape;

said cover being hingedly connected to said mounting member;

said cover having a spring finger on each of said lateral sidewalls;

whereby, when said mounting member is placed over a faucet handle and secured to a structural wall, and said cover is rotated upward such that said spring fingers are inserted into said spring finger catches, said faucet handle cannot be manipulated until lateral force is simultaneously applied to both of said spring fingers causing said spring fingers to deform inwardly thereby disengaging said catch members from said catch slots; and said cover is rotated downward.

2. The device of claim 1 wherein: each of said spring fingers are defined by two parallel notches extending from the edges of said lateral sidewalls, that are opposite said cover plate, towards said cover plate.

3. The device of claim 1 wherein: each of said spring finger catches has a catch slot communicating into said spring finger catch from said side edge, each of said spring fingers has a catch member extending laterally from the terminal end of said spring finger; and whereby when said spring finger is inserted into said spring finger catch, said catch member is engaged in said catch slot.

4. The device of claim 1 wherein said faucet handle insertion hole is capable accommodating a faucet handle selected from a group of faucet handles having a plurality of shapes and dimensions.

5. The device of claim 1 wherein said cover is constructed from a material having an elastic memory sufficient to bias said spring fingers to their original position after said lateral force has been removed.

6. The device of claim 1 wherein said cover is constructed from a material sufficiently resistant to deformation that a small child cannot generate a force on said spring fingers sufficient to simultaneously disengage both of said catch members from said catch slots with his or her hands.

7. The device of claim 1 wherein said cover is sufficiently wide that a small child cannot manipulate both of said spring fingers with one hand.

8. The device of claim 1 wherein said mounting member further includes a layer of adhesive material for attaching said mounting member to a structural wall.

9. The device of claim 1 wherein said mounting member further includes a plurality of mounting holes communicating through said mounting member for attaching said mounting member to a structural wall by using fastening devices inserted through said mounting holes.

10. A device for denying access to water faucet handles comprising:

a mounting member having a bottom edge, a top edge, two side edges, a front surface and a back surface;

said mounting member having a faucet handle insertion hole communicating from said back surface to said front surface, a layer of adhesive material on said back surface and a plurality of mounting holes communicating from said front surface to said back surface;

said mounting member further having a bottom plate extending outwardly from said front surface along said bottom edge, and two sidewalls each extending outwardly from said front surface along said side edges at a point that is near said bottom edge;

each of said sidewalls having a cylindrical shaped nub protruding from said the surface of said sidewalls that is opposite the front surface of said mounting member;

said mounting member having a spring finger catch along each of said side edges near said top edge;

each of said spring finger catches having a catch slot communicating into said spring finger catch from said side edge;

a cover having a cover plate with an upper edge, a lower edge, two lateral side edges, an interior surface and an exterior surface, said cover further having a top plate extending inwardly from said interior surface along said upper edge, two lateral sidewalls extending inwardly from said interior surface along said lateral edges, and a flange extending inwardly from said interior surface near said bottom edge;

each of said lateral sidewalls having a round hole communicating therethrough for hinged engagement with said nubs;

each of said lateral sidewalls further having a spring finger defined by two parallel notches extending from the edges of said lateral sidewalls, that are opposite said cover plate, towards said cover plate;

each of said spring fingers having a catch member extending laterally from the terminal end of said spring finger;

whereby, when said mounting member is placed over a faucet handle, such that said faucet handle is inserted into said faucet handle insertion hole, said mounting member is secured to a structural wall, said cover is hingedly engaged to said mounting member, and rotated upward such that said spring fingers are inserted into said spring finger catches and said catch members are engaged in said catch slots, said faucet handle cannot be manipulated until lateral force is simultaneously applied to both of said spring fingers causing said spring fingers to deform inwardly thereby disengaging said catch members from said catch slots; and said cover is rotated downward.

11. The device of claim 10 wherein said faucet handle insertion hole is capable accommodating a faucet handle selected from a group of faucet handles having a plurality of shapes and dimensions.

12. The device of claim 10 wherein said cover is constructed from a material having an elastic memory sufficient to bias said spring fingers to their original position after said lateral force has been removed.

13. The device of claim 10 wherein said cover is constructed from a material sufficiently resistant to deformation that a small child cannot generate a force on said spring fingers sufficient to simultaneously disengage both of said catch members from said catch slots with his or her hands.

14. The device of claim 10 wherein said cover is sufficiently wide that a small child cannot manipulate both of said spring fingers with one hand.

15. A device for denying access to water faucet handles comprising:

a mounting member having a bottom edge, a top edge, two side edges, a front surface and a back surface;

said mounting member having a faucet handle insertion hole communicating from said back surface to said front surface, a layer of adhesive material on said back surface and a plurality of mounting holes communicating from said front surface to said back surface;

said faucet handle insertion hole being capable of accommodating a faucet handle selected from a group of faucet handles having a plurality of shapes and dimensions;

said mounting member further having a bottom plate extending outwardly from said front surface along said bottom edge, and two sidewalls each extending outwardly from said front surface along said side edges at a point that is near said bottom edge;

each of said sidewalls having a cylindrical shaped nub protruding from said the surface of said sidewalls that is opposite the front surface of said mounting member;

said mounting member having a spring finger catch along each of said side edges near said top edge;

each of said spring finger catches having a catch slot communicating into said spring finger catch from said side edge;

a cover having a cover plate with an upper edge, a lower edge, two lateral side edges, an interior surface and an exterior surface, said cover further having a top plate extending inwardly from said interior surface along said upper edge, two lateral sidewalls extending inwardly from said interior surface along said lateral edges, and a flange extending inwardly from said interior surface near said bottom edge;

each of said lateral sidewalls having a round hole communicating therethrough for hinged engagement with said nubs;

each of said lateral sidewalls further having a spring finger defined by two parallel notches extending from the edges of said lateral sidewalls, that are opposite said cover plate, towards said cover plate;

each of said spring fingers having a catch member extending laterally from the terminal end of said spring finger;

said cover being constructed from a material having an elastic memory sufficient to bias said spring fingers to their original position after said lateral force has been removed and sufficiently resistant to deformation that a small child cannot generate a force on said spring fingers sufficient to simultaneously disengage both of said catch members from said catch slots with his or her hands;

said cover being sufficiently wide that a small child cannot manipulate both of said spring fingers with one hand;

whereby, when said mounting member is placed over a faucet handle, such that said faucet handle is inserted into said faucet handle insertion hole, said mounting member is secured to a structural wall, said cover is hingedly engaged to said mounting member, and rotated upward such that said spring fingers are inserted into said spring finger catches and said catch members are engaged in said catch slots, said faucet handle cannot be manipulated until lateral force is simultaneously applied to both of said spring fingers causing said spring fingers to deform inwardly thereby disengaging said catch members from said catch slots; and said cover is rotated downward.

* * * * *